United States Patent [19]

Snellman

[11] 4,315,621

[45] Feb. 16, 1982

[54] SHEET COLLATING DEFLECTOR

[75] Inventor: Donald L. Snellman, Seattle, Wash.

[73] Assignee: International Business Machines Corporation, Armonk, N.Y.

[21] Appl. No.: 46,233

[22] Filed: Jun. 7, 1979

[51] Int. Cl.[3] ..... B65H 29/60; B65H 39/11

[52] U.S. Cl. ..... 271/296; 271/197; 271/302; 198/364; 198/585

[58] Field of Search ..... 271/296, 302, 197, 287, 271/314, 198, 200, 184, 185; 270/58; 198/585, 364

[56] References Cited

U.S. PATENT DOCUMENTS

| | | | |
|---|---|---|---|
| 2,328,317 | 8/1943 | Wentworth | 271/296 X |
| 3,414,254 | 12/1968 | Snellman et al. | 271/296 X |
| 3,561,753 | 2/1971 | Snellman | 271/296 X |
| 3,638,937 | 2/1972 | Schulz et al. | 271/296 X |
| 3,815,899 | 6/1974 | Hatzmann | 271/314 |
| 3,942,786 | 3/1976 | Lauren | 271/314 X |
| 3,963,235 | 6/1976 | Snellman et al. | 271/197 X |
| 4,006,894 | 2/1977 | Raible et al. | 271/296 |
| 4,216,955 | 8/1980 | Avritt et al. | 271/296 |

OTHER PUBLICATIONS

Hancock, E. C. et al., "Collator", *IBM Technical Disclosure Bulletin,* vol. 21, No. 12, May 1979, pp. 4776–4779.

*Primary Examiner*—Bruce H. Stoner, Jr.

[57] ABSTRACT

A collator mechanism for transporting and feeding sheets of material such as paper, microfiche film or the like to individual bins. The sheets are carried by an apertured conveyor tape which slides along an apertured vacuum manifold so that the sheet is maintained in contact with the tape by the vacuum. The conveyor tape delivers the sheet to a deflector assembly which is progressively stepped through a plurality of indexed positions adjacent the bins. The deflector assembly includes upper and lower deflector rollers which bend the tape and sheet sufficiently to feed it toward the adjacent bin, release the sheet from the tape and then bend the tape away from the sheet being conveyed and the adjacent bin. The momentum and rigidity of the sheet carries the sheet, after its release from the tape, into the adjacent bin. An idler roller receives the tape from the lower deflector roller and presses the tape against the manifold to maintain the length of the conveyor tape path constant as the deflector assembly is stepped adjacent the bins.

2 Claims, 2 Drawing Figures

SHEET COLLATING DEFLECTOR

BACKGROUND OF THE INVENTION

1. Field of the Invention

This invention relates to collators for sheets of paper and the like, and more particularly to a deflector mechanism for a sheet collating device for feeding sheets from a conveyor tape into a plurality of spaced apart bins.

2. Description of the Prior Art

Sheet collating devices are commonly used to convey sheets of planar material such as paper, microfiche film and the like to a plurality of bins in a predetermined order. One variety of collating device in use is described in U.S. Pat. No. 3,414,254 issued to Snellman, et al. The Snellman, et al collator utilizes a continuous loop of flexible tape to convey the sheet downwardly along a plurality of vertically spaced, horizontally disposed bins. A curved deflector is positioned between the tapes to remove individual sheets from the tape and deflect them into an adjacent bin. In operation the deflector is stepped through a plurality of indexed positions opposite respective bins so that sequentially received sheets are placed in sequentially positioned bins. Sliding contact between the sheet and the curved deflector exists in operation of the Snellman et al device. In most applications this sliding contact does not present a problem; however, with certain types of sheet materials such as film, which are very easily scratched, sliding contact between the sheet and deflector is avoided if possible. In operation of the Snellman et al device the deflector path can only be varied by replacing the deflector with one having a different radius of curvature, whereas with the deflector mechanism disclosed herein the angle of the deflection path of the sheet can be easily varied to vary the angle of the deflection path.

Another type of sheet collating device is described in U.S. Pat. No. 2,328,317 issued to Wentworth. The Wentworth device conveys the sheet to a movable distributor by placing the sheet between a top conveyor cord 31 and a pair of bottom conveying cords 14. When the cords reach the distributor, the lower conveyor cords 14 are immediately bent downwardly while the upper cord 31 runs along the upper periphery of two spaced-apart rollers and along the under periphery of a third roller. Consequently, the sheet is effectively released from its position between the cords just beyond the first roller of the distributor and it is only supported between the remaining rollers and the upper conveyor cord during the remainder of its travel. It is released from the upper conveyor cord at some point between the second and third rollers.

OBJECTS OF THE INVENTION

It is an object of the invention to provide a sheet collating device in which there is no slding contact between the deflector assembly and the sheet being conveyed so that there is no tendency to scratch the sheet.

It is another object of the invention to provide a sheet collating device which allows relatively quick and easy adjustment of the deflection path angle.

It is still another object of the invention to provide a sheet deflection device which is capable of accepting sheets of virtually any length.

It is a further object of the invention to provide a sheet collating device which completely supports the sheet being conveyed until it is closely adjacent the receiving bin.

These and other objects of the invention are provided by a sheet collating device comprising a column of generally vertically spaced bins, substantially vertical moving flexible sheet conveyor means positioned adjacent the vertically spaced bins for conveying sheets in a substantially vertical course, and a deflector assembly operatively associated with the sheet conveying means, the deflector assembly including first and second rotatably mounted deflector rollers having their peripheries tangent to a common deflection path, the conveying means wound on the rollers with the first surface of the conveying means facing toward the periphery of the first roller such that the sheet being conveyed is positioned between the conveying means and the first roller and with the first surface of the conveying means facing away from the periphery of the second deflection roller so as to release the sheet from the conveying means as the conveying means moves from the first deflection roller to the second deflection roller to allow the sheet to move along the deflection path.

In the form of the invention described in this application, the deflection rollers are preferably movable with respect to each other in a direction substantially perpendicular to the deflection path in order to vary the common tangent and hence the deflection path angle. The deflector assembly also preferably includes an idler roller, positioned beneath the deflection rollers for receiving the tape from the second deflection roller and positioning the tape in alignment with a line connecting the supporting end points for the tape on opposite sides of the deflector assembly in order to prevent the length of the tape path from varying as the deflector assembly is stepped along a plurality of indexed positions opposite respective bins. The second deflector roller is preferably positioned as close as possible to the receiving bins to prevent the sheets being conveyed from deviating from the deflection path, even with relatively flexible sheet materials. It is also important that the sheet rest upon the upper surface of the conveying tape intermediate the first and second deflection roller so that the leading edge of the sheet maintains contact with the conveyor tape. The tape conveying structure is inherently capable of accurately directing virtually any size sheet to a chosen receiving bin regardless of the sheet's lack of rigidity without scratching or otherwise damaging sheets having a relatively soft surface.

DETAILED DESCRIPTION OF THE INVENTION

Sheet collating devices of the type described are useful for distributing flexible planar materials such as paper of various weights and sizes, plastic sheets, film or other types of materials into separate bins generally the sheets of paper to be fed onto endless conveyor tapes which carry each sheet past a series of vertically spaced bins. The sheets of paper are deflected into one of a vertical column of receiving bins by a deflector mechanism. The deflector mechanism described in U.S. Pat. No. 3,414,254 is a curved plate extending between the conveyor tapes of the collator that intercepts the sheets of paper being conveyed, strips them from the conveyor tapes and deflects them into the respective bin.

In contrast to the deflecting mechanism described in the '254 patent, the deflector mechanism described herein is one in which the direction of the conveying belts or tapes conveying the paper to be collated is changed in front of the entrance to the appropriate bin to convey the sheet of paper first vertically and then deflect the tape nearly horizontally toward the entrance to the appropriate bin and then sharply change the direction of travel of the conveyor tape to turn sharply away from the paper path separating the paper from the conveyor tape and allowing it to continue in its nearly horizontal direction into the bin.

Figure 1:
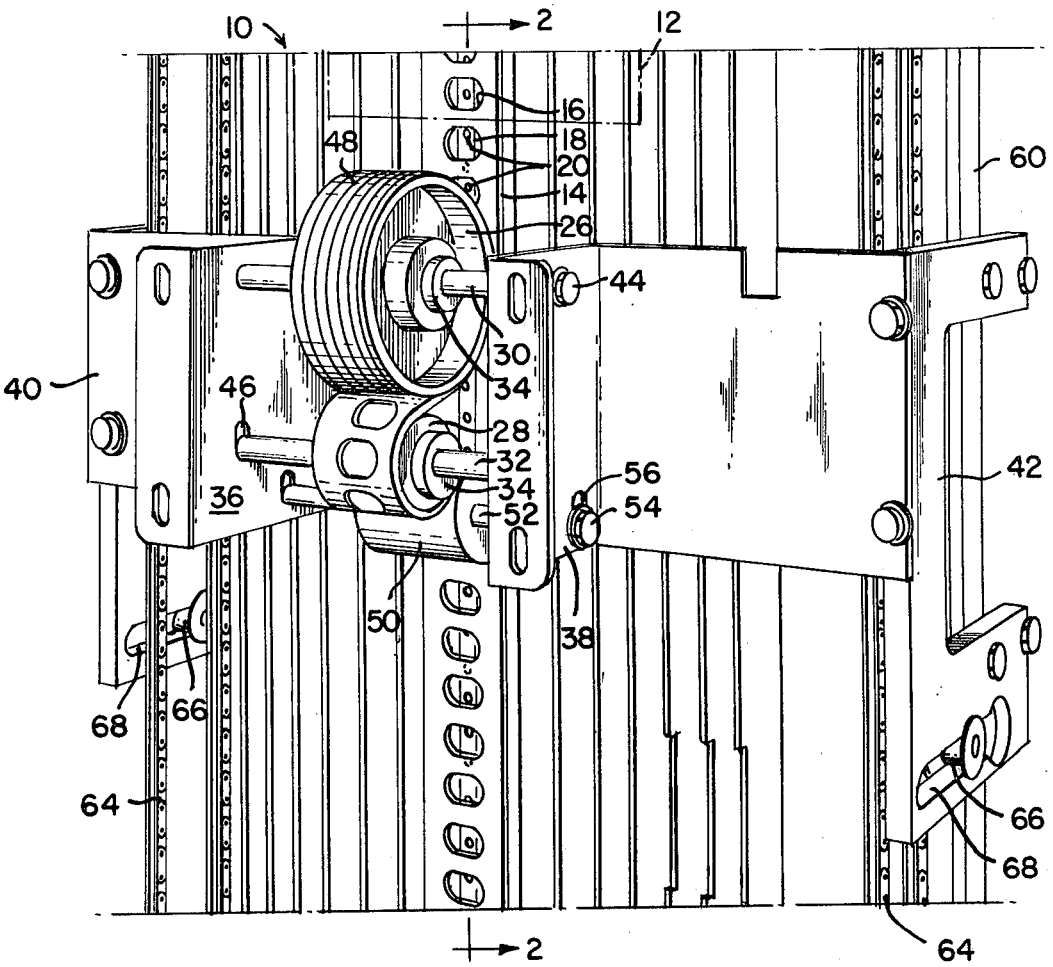
FIG. 1 is an isometric view of the collating mechanism.

The collating deflector as illustrated in FIG. 1 includes a deflector assembly 10 which receives a sheet 12 of flexible material such as paper, film or the like and deflects it horizontally to the left as illustrated in FIG. 1. The sheet 12 is carried by a flexible conveyor tape 14 containing a plurality of spaced apart apertures 16. The tape 14 moves along the smooth, flat surface of a vacuum manifold 18 communicating with the tape through a plurality of apertures 20. The vacuum draws the sheet 12 against the conveyor tape 14 through the apertures 16 and 20 so that as the tape 14 moves downwardly, as illustrated in FIG. 1, the sheet 12 moves with the tape 14.

The deflector assembly 10 includes upper and lower deflector rollers 26, 28, respectively, which are rotatably mounted on shafts 30 and 32 by conventional bearings 34. The ends of the shafts 30, 32 are supported by opposed side plates 36, 38 of support frames 40,42, respectively, and are held in place by appropriate means, such as, for example, screw 44 passed through the shaft 30. The screw 54 for the lower deflector roller shaft 32 extends through slotted openings, for example 46, in the plates 36, 38 to allow vertical adjustment of the lower deflector roller 28 so that the deflection angle of the sheets 12 can be varied, as explained hereinafter. The peripheral surface of the upper deflector roller 26 is covered with a resilient material such as a plurality of resilient O-rings 48 to protect the sheet 12 from being scratched or otherwise damaged.

The deflector assembly 10 also includes an idler roller 50 rotatably mounted on a shaft 52 by conventional bearings (not shown). The ends of the shaft 52 are carried by the side plates 36, 38 and fastened in place by screw 54 which extends through slots 56 to allow vertical adjustment of the idler roller 50 with respect to the deflector rollers to adjust the tension of the tape 14. An idler roller is preferably used, but not critical to the operation of the deflector assembly since it is the upper and lower deflector rollers 26, 28, respectively, which deflect the sheet 12 into the bins. The idler roller 50 does, however, press the tape 12 against the surface of the vacuum manifold 18 so that the length of the tape path remains constant as the deflector assembly 10 steps along the bins as explained hereinafter. Without an idler roller, as shown, or elsewhere along the tape path, it would be necessary for the tape path to be longer when the deflector assembly 10 was near the upper and lower bins, requiring a constant tension device with a relatively large range.

Figure 2:
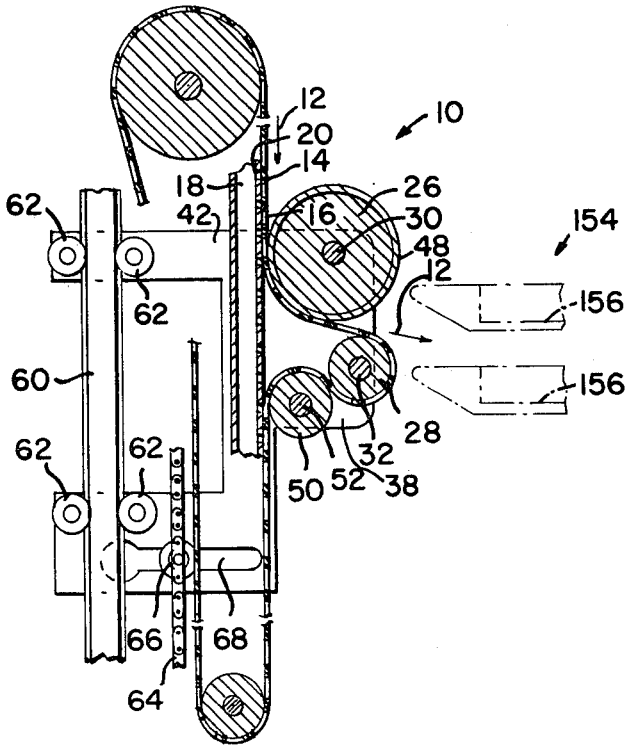
FIG. 2 is a cross-sectional view taken along the line 2—2 of FIG. 1.

As best illustrated in FIG. 2, the conveyor tape 14 carries the sheet 12 between the upper and lower deflector rollers 26, 28, respectively. The stiffness and momentum of the sheet 12 causes it to move in a generally horizontal direction to the right as illustrated in FIG. 2 as the tape 14 wraps around the lower feed roller 28. A receiver 154 in the form of a plurality of vertically spaced, shelves or bins 156 is positioned adjacent the deflector assembly 10 as explained hereinafter.

It will be noted from FIG. 2 that the deflection path of the sheet 12 is approximately coincident to a line which is tangent to the peripheries of both the upper deflection roller 26 and the lower deflection roller 28. The angle of the deflection path can be easily adjusted by vertical adjustment of the lower deflector roller.

An important difference between the deflection assembly 10 and prior art deflector structures, such as the structure disclosed in the Wentworth patent, is that the entire length of the sheet 12 is continuously supported between the tape 14 and upper deflection roller 26 until the sheet is released beyond the roller 26. Furthermore, the release location for the sheet being conveyed is closely adjacent the bins 156, thereby lessening the possibility that the sheet 12 will stray from the intended deflection path. In contrast, the Wentworth structure only supports the sheet at spaced apart points. Also, the release point is a greater distance from the bins so that some sheets, particularly those lacking ridigity, may deflect from the intended deflection path.

The frame members 40, 42 are carried by respective vertical rails 60. Spaced apart pairs of rollers 62 are bolted to the frame members 40 and 42 so that they straddle the rails 60 thereby fixing the horizontal position of the deflector assembly 10 while allowing the deflector assembly 10 to move vertically along the length of the rails 60. A pair of chains 64 carry respective transversely projecting rods 66 which extend through slots 68 formed in the frame members 40, 42. The chain 64 forms a continuous loop around a pair of sprockets (not shown) positioned above and below the deflector assemby 10. As the chain rotates around the sprockets the deflector assembly 10 moves vertically in one direction until the upper or lower sprocket is reached at which point the rods 66 move horizontally in the slots 68 and the deflector assembly 10 then moves vertically in the opposite direction. By accurately controlling the position of the chain the deflector assembly can be stepped through a succession of indexed positions opposite each of the bins 156.

In operation a plurality of sheets 12 are placed onto the tape 14 from a duplicating machine, photocopy machine or film developer. The deflector assembly is first moved to a position where the upper and lower deflector rollers 26, 28 are adjacent a first bin 156. The first sheet 12 is carried between the upper deflector roller 26 and the lower deflector roller 28 and is deflected into the first storage bin 156. The passage of the sheet 12 is detected by a suitable device, such as a conventional optical sensing system which provides a signal to cause the deflector assembly 10 to step opposite the next bin 156. After the passage of each sheet 12 is detected by the sensor, the deflector assembly 10 is stepped to the next bin 156 in preparation for the receipt of a subsequent sheet. Although the sheet collating deflector has been described as used with a collator in which sequentially received sheets are placed in adjacent vertically spaced, horizontally disposed bins, it will be understood that the deflector mechanism can be used in connection with horizontally spaced vertical bins or with collating, systems in which sequentially received sheets are placed in predetermined bins which are not necessarily adjacent each other.

I claim:

1. An improved sheet collating device comprising:

a column of spaced bins generally arranged along a line;

moving flexible sheet conveying means having a first surface on which the sheets to be conveyed rest positioned adjacent the spaced bins for conveying the sheets to be collated in a course substantially parallel to said line;

a deflector assembly operatively associated with the sheet conveying means for changing the orientation of the conveying means and thereby varying the course of the sheets, the deflector assembly including first and second rotatably mounted deflector rollers spaced from each other and having their peripheries tangent to a common deflection path defined by the conveying means, the conveying means being wound on the rollers so that the first surface of the conveying means faces toward the periphery of the first roller such that the sheet to be collated is positioned between the conveyor means and the first roller, the first surface of the conveying means facing away from the periphery of the second deflection roller to release the sheet being collated from the conveying means as the conveying means moves from the first deflection roller to the second deflection roller so as to allow the sheet being collated to move along the deflection path at an angle to the bin line; and means whereby the position of the second deflector roller is adjustably movable relative to the first deflection roller to change the conveying means orientation and thereby vary the angle of the deflection path during normal operation relative to the bin line.

2. A sheet collating assembly, comprising:

a deflector assembly selectively movable in a vertical direction to a plurality of discrete positions, the deflector assembly including first and second rotatably mounted deflector rollers having their peripheries separated from each other tangent to a generally horizontal deflection path, and an idler roller positioned beneath the second deflector roller, the first deflector roller and the idler roller having a substantially vertical common tangent at the peripheries of the rollers opposite the deflection path;

an elongated vacuum manifold disposed along a vertical axis and having a smooth surface facing in the direction of the deflection path, the vacuum manifold having a plurality of apertures extending between the interior of the manifold and the smooth surface;

a continuous loop of conveyor tape running along the smooth surface between a pair of conveyor tape rollers, with the deflector assembly positioned therebetween so that the conveyor tape wound around the deflector rollers and the idler roller forms a generally s-shaped curve relative to the surface of the conveyor tape facing away from the vacuum manifold and contacting the peripheral surface of the first deflector roller and the idler roller while the opposite surface of the conveyor tape contacts the peripheral surface of the second deflection roller, whereby the middle portion of the S-shaped curve defines the deflection path;

a plurality of generally vertically spaced bins positioned adjacent the deflector assembly at locations corresponding to the discrete positions, each of the bins including a slot adapted to receive a sheet, along the deflection path, from the deflector assembly when the deflector assembly is positioned adjacent the bin and the tape moves from the first deflection roller to the second deflection roller; and means whereby the position of one of the deflector rollers is vertically adjustable to vary the conveyor tape curve between the tape rollers whereby the angle of the deflection path during normal operation is changed.

* * * * *